US009061738B2

(12) United States Patent
Eriksson et al.

(10) Patent No.: US 9,061,738 B2
(45) Date of Patent: Jun. 23, 2015

(54) CRANE ON A VESSEL

(75) Inventors: Anders Eriksson, Lillesand (NO); Thor Strand, Kristiansand S (NO)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 473 days.

(21) Appl. No.: 13/517,262

(22) PCT Filed: Dec. 21, 2010

(86) PCT No.: PCT/GB2010/002309

§ 371 (c)(1), (2), (4) Date: May 2, 2013

(87) PCT Pub. No.: WO2011/077085

PCT Pub. Date: Jun. 30, 2011

(65) Prior Publication Data

US 2013/0220204 A1 Aug. 29, 2013

Related U.S. Application Data

(60) Provisional application No. 61/288,364, filed on Dec. 21, 2009.

(51) Int. Cl.

| | |
|---|---|
| ***B63B 27/12*** | (2006.01) |
| ***B63B 21/04*** | (2006.01) |
| ***B66C 19/00*** | (2006.01) |

(52) U.S. Cl.

CPC ..... *B63B 27/12* (2013.01); *B63B 21/04* (2013.01); *B66C 19/00* (2013.01)

(58) Field of Classification Search

CPC ..... B63B 27/12
USPC ..... 114/268; 414/138, 141.5
See application file for complete search history.

(56) References Cited

U.S. PATENT DOCUMENTS

| | | | |
|---|---|---|---|
| 1,428,809 | A | 9/1922 | Zimmerman |
| 2,343,014 | A | 2/1944 | Langan |

(Continued)

FOREIGN PATENT DOCUMENTS

| | | | |
|---|---|---|---|
| BE | 708038 | A | 4/1968 |
| DE | 1215019 | B | 4/1966 |

(Continued)

OTHER PUBLICATIONS

PCT/GB2010/002309 International Search Report and Written Opinion dated Oct. 19, 2011 (11 p.).

(Continued)

*Primary Examiner* — Lars A Olson
*Assistant Examiner* — Jovon Hayes
(74) *Attorney, Agent, or Firm* — Conley Rose, P.C.

(57) ABSTRACT

A travelling crane arrangement provided on a floating vessel having a deck and a pair of substantially parallel tracks comprises a pair of uprights configured to move along the respective tracks. In addition, the travelling crane arrangement comprises a transverse beam extending between said uprights across the deck of the vessel in spaced relation thereto. Further, the travelling crane arrangement comprises a trolley configured to move along the beam. The trolley carries at least part of a lifting mechanism configured to lift a load above the deck. Still further, the crane arrangement includes a support selectively positionable in a brace position extending between the deck and the trolley. In the brace position, the support is configured to at least partially support the beam in compression during use of the lifting mechanism to lift or otherwise support the weight of a load.

26 Claims, 22 Drawing Sheets

(56) References Cited

U.S. PATENT DOCUMENTS

| | | | | | |
|---|---|---|---|---|---|
| 2,490,609 | A | * | 12/1949 | Andersen | 414/141.5 |
| 2,984,367 | A | | 5/1961 | McIntyre | |
| 3,042,227 | A | | 7/1962 | Tantlinger | |
| 3,061,112 | A | | 10/1962 | Bevard | |
| 3,074,563 | A | | 1/1963 | Montgomery | |
| 3,220,571 | A | * | 11/1965 | Kummerman | 414/141.5 |
| 3,244,297 | A | | 4/1966 | Kinkopf | |
| 3,248,487 | A | | 4/1966 | Dechantsreiter | |
| 3,390,657 | A | | 7/1968 | Schneider | |
| 3,486,641 | A | | 12/1969 | Zweifel et al. | |
| 3,494,485 | A | | 2/1970 | Hasegawa | |
| 3,550,788 | A | | 12/1970 | Auzins | |
| 3,598,256 | A | | 8/1971 | Kinkopf | |
| 3,645,405 | A | | 2/1972 | Stiglich | |
| 3,696,947 | A | * | 10/1972 | Ponsen | 414/141.3 |
| 4,027,800 | A | | 6/1977 | Polen | |
| 4,106,641 | A | | 8/1978 | Campbell et al. | |
| 4,227,846 | A | * | 10/1980 | Koskivirta | 414/138.7 |
| 5,511,268 | A | * | 4/1996 | Albus et al. | 14/77.1 |
| 6,516,737 | B2 | * | 2/2003 | Le Coz et al. | 114/72 |
| 7,845,296 | B1 | * | 12/2010 | Khachaturian | 114/50 |
| 2002/0129755 | A1 | * | 9/2002 | Hagen et al. | 114/268 |
| 2010/0068008 | A1 | * | 3/2010 | Yoon | 414/138.5 |
| 2010/0263581 | A1 | * | 10/2010 | Khachaturian | 114/61.16 |
| 2011/0036287 | A1 | * | 2/2011 | Wijning et al. | 114/74 R |
| 2013/0220204 | A1 | * | 8/2013 | Eriksson et al. | 114/268 |
| 2013/0284081 | A1 | * | 10/2013 | Kalkman et al. | 114/268 |

FOREIGN PATENT DOCUMENTS

| | | | | |
|---|---|---|---|---|
| DE | 2406730 | A1 | | 8/1975 |
| DE | 2543156 | A1 | | 3/1977 |
| DE | 9108874 | U1 | | 11/1992 |
| DE | 4123931 | A1 | | 1/1993 |
| DE | 202008006569 | | | 7/2008 |
| FR | 1239793 | A | | 8/1960 |
| FR | 2072861 | A7 | | 9/1971 |
| FR | 2313256 | A1 | | 12/1976 |
| FR | 2363510 | A1 | | 3/1978 |
| FR | 2385636 | A1 | | 10/1978 |
| FR | 2428565 | A1 | | 1/1980 |
| GB | 596544 | A | | 1/1948 |
| GB | 1025017 | A | | 4/1966 |
| GB | 1027343 | | * | 4/1966 |
| GB | 1125281 | A | | 8/1968 |
| GB | 1170847 | A | | 11/1969 |
| GB | 1193605 | A | | 6/1970 |
| GB | 1232873 | A | | 5/1971 |
| GB | 1462074 | A | | 1/1977 |
| GB | 2005223 | A | | 4/1979 |
| GB | 2398062 | B | | 6/2005 |
| JP | S5064952 | A | | 6/1975 |
| JP | S527555 | U | | 1/1977 |
| JP | S5465992 | A | | 5/1979 |
| JP | S54143570 | U | | 10/1979 |
| JP | S54144592 | U | | 10/1979 |
| JP | S54147965 | U | | 10/1979 |
| JP | S5587685 | A | | 7/1980 |
| JP | S55115588 | A | | 9/1980 |
| JP | S57105893 | U | | 6/1982 |
| JP | S59108780 | U | | 7/1984 |
| JP | S59108784 | U | | 7/1984 |
| JP | S60133888 | U | | 9/1985 |
| JP | S60159789 | U | | 10/1985 |
| JP | S6138297 | U | | 3/1986 |
| JP | 011118982 | U | | 8/1989 |
| JP | 02006057 | Y2 | | 2/1990 |
| JP | 07137981 | A | | 5/1995 |
| JP | 07024316 | Y2 | | 6/1995 |
| JP | 07041672 | Y | | 9/1995 |
| JP | H1036076 | A | | 2/1998 |
| JP | 2000318976 | A | | 11/2000 |
| JP | 2002087758 | A | | 3/2002 |
| NL | 6917389 | A | | 5/1971 |
| NL | 7801497 | A | | 5/1979 |
| NO | 325335 | B1 | | 3/2008 |
| WO | 97/29945 | A1 | | 8/1997 |
| WO | 03/047958 | A1 | | 6/2003 |
| WO | 2007/073209 | A1 | | 6/2007 |
| WO | 2009/005367 | A2 | | 1/2009 |
| WO | WO 2011077085 | A3 | * | 12/2011 |

OTHER PUBLICATIONS

PCT/GB2010/002309 International Preliminary Report on Patentability dated May 18, 2012 (13 p.).

* cited by examiner

CRANE ON A VESSEL

CROSS REFERENCE TO RELATED APPLICATIONS

This application is a 35 U.S.C. §371 national stage application of PCT/GB2010/002309 filed Dec. 21, 2010, which claims the benefit of U.S. Provisional Application No. 61/288,364 filed Dec. 21, 2009, both of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The present invention relates generally to crane systems and arrangements for marine vessel applications. More particularly, the invention relates to a travelling crane arrangement for a floating vessel.

2. Background of the Technology

Vessels utilized for anchor handling, such as so-called Anchor Handling Tug Vessels (AHTVs) are often equipped with a stern roller and a relatively heavy winch. When an anchor is to be deployed, an anchor rope, that may include a chain, a wire or a rope, is connected to the anchor, and the anchor is lowered into the sea over the stern roller by letting out rope from the winch. Retrieving an anchor is undertaken by performing the operations in reversed order. Large forces are encountered during such operations and sometimes assistance is needed from another vessel in order to ensure safe working conditions.

Conventional approaches for overcoming unsafe operations are described in, for example, WO2009/005367. The '367 publication proposes a roller that is parallel to the stern of the vessel and connected to two arms. The arms, which are hinged close to the stern of the vessel, are moving the roller between an idle position below the deck and an active position above the stern. When an anchor is to be deployed, the anchor is placed on the deck behind the roller. The roller is moved towards its active position, thus lifting the anchor at least partly off the deck. The anchor may be lowered clear of the stern as the rope is let out over the roller. A disadvantage of the equipment is that the roller is moving along a fixed path and does not offer the flexibility of a crane.

NO325335 shows a transverse crane that spans across a vessel. The crane includes a remotely operated arm for handling anchor equipment.

BRIEF SUMMARY OF THE DISCLOSURE

It is an object of the present invention to provide an improved crane arrangement for a floating vessel.

According to the present invention, there is provided a travelling crane arrangement for a floating vessel having a pair of substantially parallel tracks, the crane arrangement comprising: a pair of uprights for movement on respective said tracks, a transverse beam extending between said uprights so as to extend across a deck of the vessel in spaced relation thereto, the beam having a trolley arranged for movement along the beam, the trolley carrying at least part of a lifting mechanism operable to lift a load above the deck, wherein the crane arrangement is characterised by the provision of a support selectively positionable in an brace position in which it extends between the deck and the trolley to at least partially support the beam in compression during use of the crane to lift or otherwise support the weight of a load. The terms "tracks" is used herein to refer to any convenient elongate member along which other components of the arrangement may run and thus includes, for example, rails, channels or the like. Preferably the tracks are arranged to extend in a substantially stem-stem direction of the vessel and may either me mounted directly on or in the cargo deck or other deck of the vessel, or be raised above the deck, for example in the region of the vessel's gunwales.

Preferably, said support comprises an arm slideably mounted to said trolley for sliding movement between a retracted position in which the arm is substantially clear of the deck and a brace position in which a lower end of the arm engages the deck to support the beam.

Conveniently, said arm forms part of said lifting mechanism and is configured for use in lifting a load when not engaged with the deck to support the beam, the lifting mechanism being operable to lift said load by slideably raising the arm relative to the trolley.

Advantageously, said lifting mechanism comprises a lifting member arranged for sliding movement along said support, the lifting mechanism being operable to lift a load via upwards movement of the lifting member along the support.

Preferably, said lifting mechanism is operable for independent movement of i) said arm relative to said trolley, and ii) said lifting member relative to said arm.

Advantageously, said lifting mechanism is operable to move said lifting member relative to said arm whilst the lower end of said arm is engaged with the deck to support the beam.

Conveniently, said lifting member comprises a rotatably mounted sheave, the lifting member being operable via movement of a wire or rope passing around the sheave.

Preferably, the crane arrangement is provided in combination with a tool releasably connectable to said lifting member.

Alternatively, or additionally, the crane arrangement may be provided in combination with a tool releasably connectable to the lower end of said arm.

Preferably, the or at least one said tool is a gripping tool.

Advantageously, the or at least one said tool is remotely controlled.

Conveniently, the tool comprises a robotic arm.

Preferably, the crane arrangement comprises two said trolleys, each trolley being arranged for independent movement along said beam and having a respective said support.

Advantageously, each said support has a respective said lifting member, the lifting mechanism being operable to raise and lower said lifting members either independently of one another or in synchronism.

Conveniently, said lifting members are arranged in facing relation to one another, thereby permitting each to be connected to a respective part of a load extending between said supports.

Preferably, the arrangement further comprises a pair of carriages configured for sliding movement along respective said tracks, wherein each said upright is pivotally connected to a respective said carriage and is thus arranged for tilting movement about a substantially horizontal axis.

Advantageously, said beam is pivotally connected to each said upright about a substantially horizontal axis and is arranged for tilting movement relative to said uprights. Conveniently, the arrangement is provided on a vessel and the lower end of the or each said arm is releasably connectable to a respective fitting mounted in or on the deck of the vessel when the arm is in its operative position.

Preferably, the vessel is provided with a roller hook comprising a roller mounted for rotation about an axis between a pair of spaced apart side members, the roller hook having a stowed position beneath the deck of the vessel.

Advantageously, said side members are each configured for connection to a respective said lifting member, the roller hook thus being arranged to be lifted clear of the deck by said lifting members.

Conveniently, said roller hook is received within a cradle when in said stowed position, the cradle being mounted for transverse sliding movement in or below said deck, and wherein said fittings for connection to the lower ends of said arms are provided on the cradle in spaced relation to one another on respective sides of the roller hook.

BRIEF DESCRIPTION OF THE DRAWINGS

So that the invention may be more readily understood, and so that farther features thereof may be appreciated, embodiments of the invention will now be described by way of example with reference to the accompanying drawings in which.

DETAILED DESCRIPTION OF THE PREFERRED EMBODIMENTS

Figure 1:
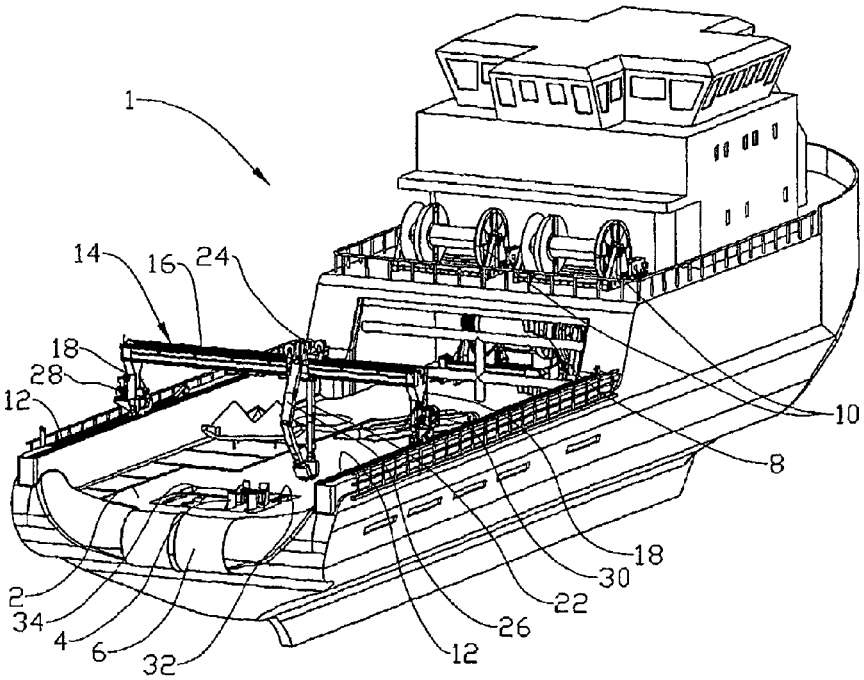
FIG. 1 is a perspective view of vessel for anchor handling operations that includes a crane and a roller hook.

Referring initially to FIG. 1, there is illustrated a marine vessel 1 of a so-called Anchor Handling Tug Vessel (AHTV) type. The vessel has a deck 2 including retractable towing pins 4 and stern rollers 6 as is conventional for such vessels. The vessel 1 is also equipped with a heavy winch 8 at deck level and a pair of lighter winches 10 position raised above the deck 2, on the vessel's superstructure.

Along each side of the deck 2 there are provided respective tracks 12 for a crane 14 of a gantry type. The tracks 12 are parallel, extend in the stem-to-stern direction of the vessel and are shown mounted to the gunwales of the vessel, at positions raised above the deck 2. However, it is to be appreciated that the tracks could alternatively be mounted in or on the deck 2.

Figure 5:
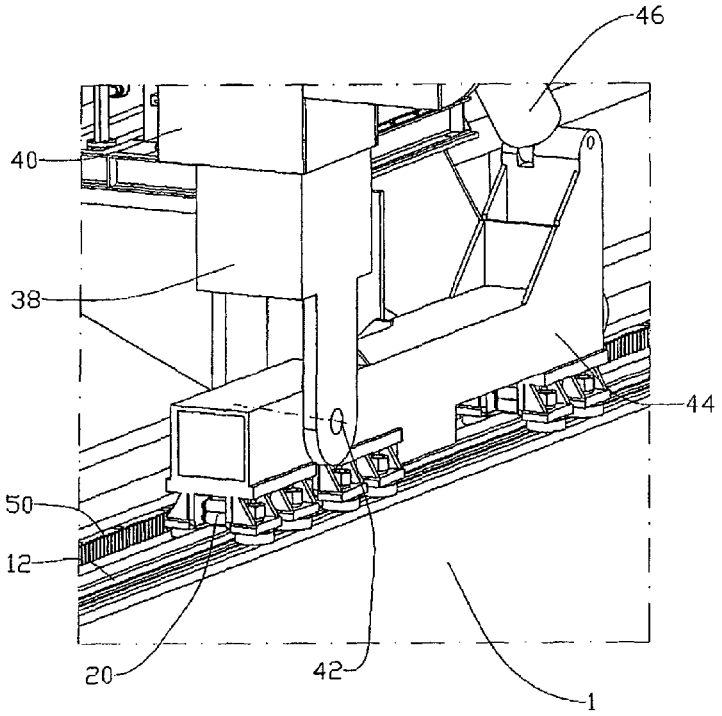
FIG. 5 shows to a larger scale a perspective view of a the interface between an upright of the crane and the vessel.

The crane 4 includes a transverse beam 6 that extends between two uprights 18. The uprights are movable on wheels 20 along the tracks 12, as shown most clearly in FIG. 5.

A lifter 22 for lifting of heavy loads is connected to a trolley 24. The trolley 24 is movable along the transversal beam 16. A knuckle boom 26 is also connected to the trolley 24.

A hydraulic aggregate 28 and winch 30 for operating the lifter 22 via and arrangement of wires and pulleys are fixed to the crane 14.

A roller hook 32 is positioned in an aperture 34 in the deck 2 at a position in front of the towing pins 4.

Figure 2:
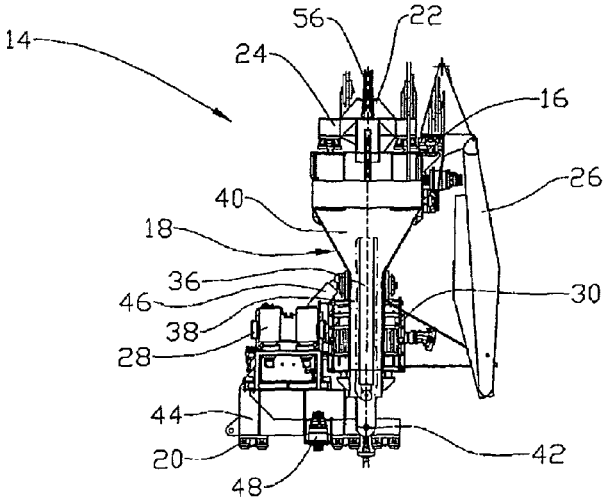
FIG. 2 shows to a larger scale an end view of the crane where the upper part of the crane is in its lower position.
Figure 3:
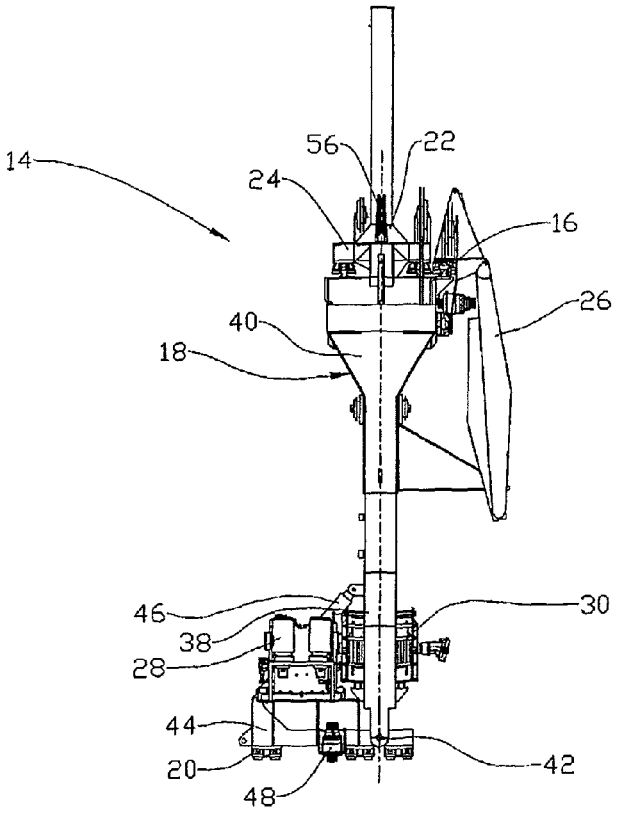
FIG. 3 shows an end view of the crane where the upper part of the crane is in its upper position.

The uprights 18 of the crane are extendible. A first hydraulic ram 36 is connected between a lower telescopic part 38 and an upper telescopic part 40 of each upright as shown most clearly in FIG. 2. In FIG. 2 the transverse beam 16 is shown in its lower position with the first ram 36 fully retracted. FIG. 3 shows the upper telescopic part 40 having been driven upwardly with respect to the lower telescopic part 38 via extension of the first hydraulic ram 36, the resultant effect being to raise the transverse beam 16 to the upper position illustrated. The first ram 36 is not shown in FIG. 3.

Figure 4:
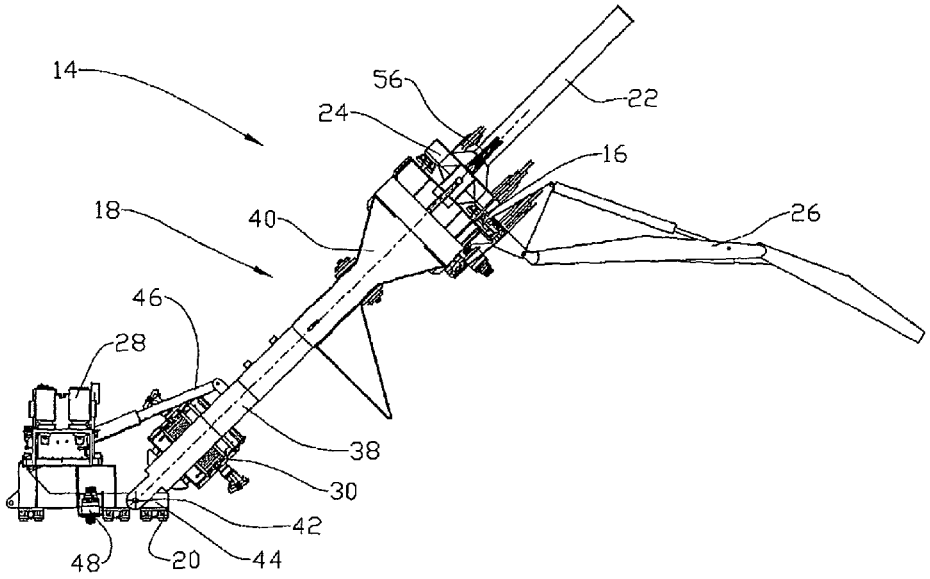
FIG. 4 shows an end view of the crane where the crane is tilted and a manipulator arm is extending from the crane.

The lower telescopic part 38 of the upright is pivotally mounted about an axis 42 to a carriage 44. The carriage 44 holds the wheels 20. A second hydraulic ram 46, which is connected between the carriage 44 and the lower telescopic part 38 of the upright, is designed to tilt the transverse beam 16 and the uprights 18 about the axis 42 upon extension, as illustrated in FIG. 4. In FIG. 4 the knuckle boom 26 is shown in an extended position suitable for forerunner work.

In this arrangement each carriage 44 is moved along its respective track 12 via operation of a hydraulic motor 48 which is mounted to the carriage and which engages with a toothed, rack 50 extending parallel to the track 12 in close spaced relation thereto. This is illustrated most clearly in FIG. 5.

Figure 6:
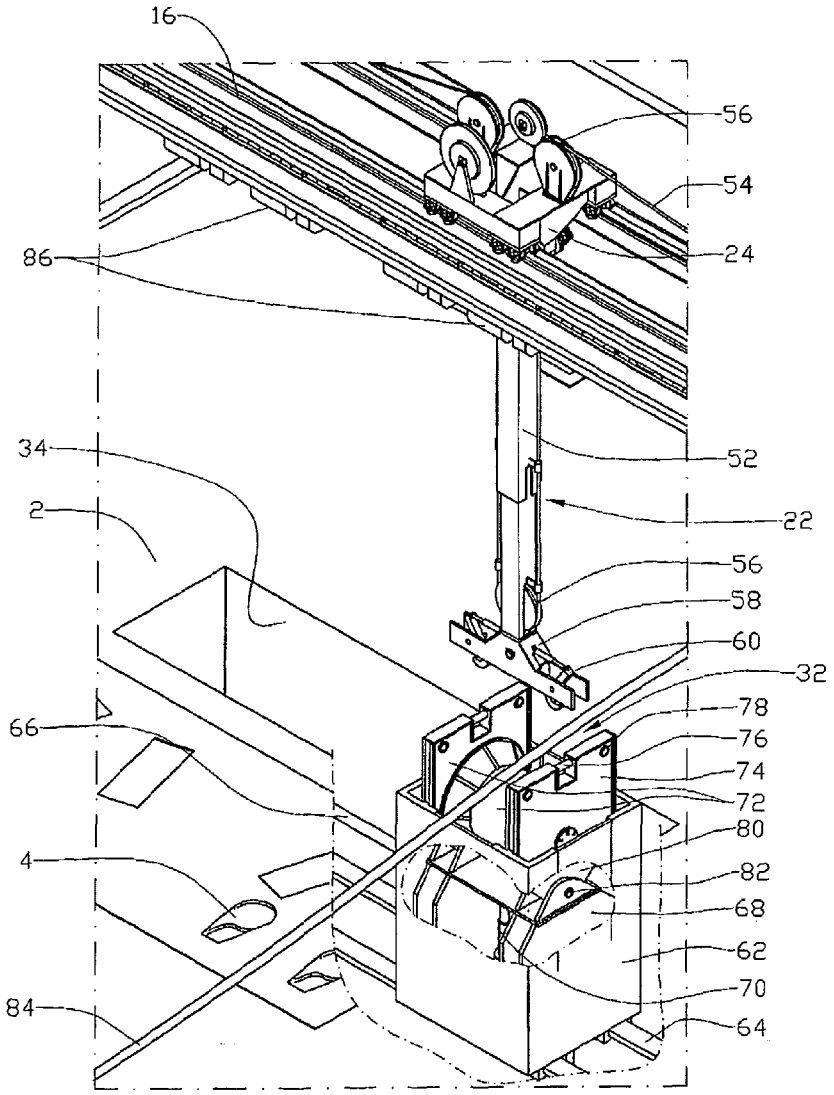
FIG. 6 shows in a perspective view a section of the deck of the vessel including a roller hook in its lower position and a lifter of the crane.
Figure 7:
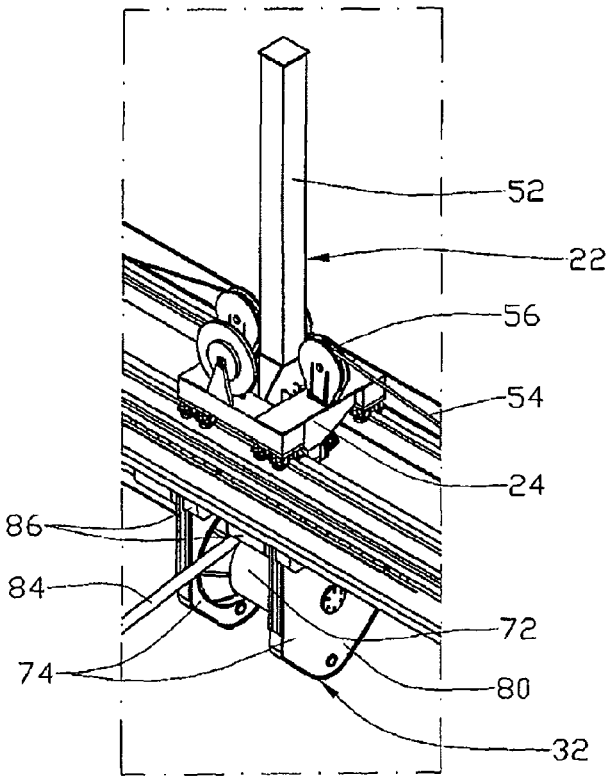
FIG. 7 shows in a perspective view the roller hook fixed to the crane.

The lifter 22 is equipped with a telescopic lifting arm 52 that is extendible in the vertical direction as illustrated most clearly in FIGS. 6 and 7. A wire 54, which is connected to the winch 30, is shown running in a well known manner over pulleys 56 on the trolley 24 and on the arm 52. The knuckled boom 26 is not shown in FIGS. 6 and 7.

At its lower end, the telescopic arm 52 is equipped with a cross-beam 58 that includes two actuator-operated hooks 60 which are spaced apart from one another at opposite ends of the cross-beam 58.

A cradle 62 is positioned in the aperture 34 in the deck 2, as shown in FIG. 6. The cradle 62 is movable in the aperture 34 on transversely oriented tracks 64 via a first actuator 66 in the starboard-portside direction of the vessel 1.

The cradle 62 includes an elevating module 68. The elevating module 68 is movable in the vertical direction relative to the cradle 62 by a second actuator 70.

The roller hook 32 includes a roller 72 which is mounted for rotation about an axis between a pair of spaced apart side members 74. The roller 72 is thus free to rotate relative to the side members 74. Each side member carries a fitting in the form of a catch 76 along its upper edge, each catch being configured for engagement with the hooks 60 of the cross-beam 58. In addition, each side member 74 is also provided with a pair of extendible locks 78 arranged at respective upper corners of the side members.

The roller hook 32 is pivotally connected to the elevating module 68 via respective releasable pivotal connections 80 at the lower regions of the two side members 74.

In its idle position, the roller hook 32 rests on the elevating module 68 in the cradle 62 below the deck 2. When the roller hook 32 is to be activated, a rope (or a wire or a chain) 84 will normally be located between the towing pins 4 as shown in FIG. 6. The cradle 62 with the roller hook 32 is moved in the starboard-portside direction so as to position the roller 72 beneath the rope 84. The elevating module 68 is then elevated to lift the roller hook 32, preferably until the roller abuts the rope 84, and the connections 80 are released leaving the roller hook resting on the elevating module but not pinned thereto. The crane 14 is then moved along the tracks 12 and the trolley is moved along the transverse beam 16 as necessary to position the lifter 22 over the roller hook 32. The telescopic arm 52 is then extended so as to lower the cross-beam 58 towards the roller hook. As illustrated in FIG. 6, the cross-beam spans the gap between the side members 74 of the roller hook and the hooks 60 at each end of the cross-beam engage respective catches 76.

Figure 8:
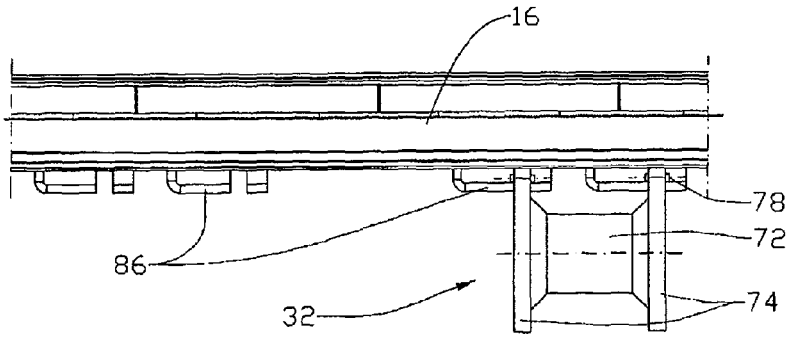
FIG. 8 shows a side view of the roller hook fixed to the crane.

The lifter 22 then moves the roller hook 32 upwardly towards the traverse beam 16 where the side members 74 engage within complementary receptacles 86 as shown in FIGS. 7 and 8. The locks 78 are then operated to engage with the receptacles 86, whereupon the lifter 22 may be disconnected from the roller hook 32, leaving the roller hook 32 secured to the transverse beam 16 in the raised position above the deck 2.

Figure 9:
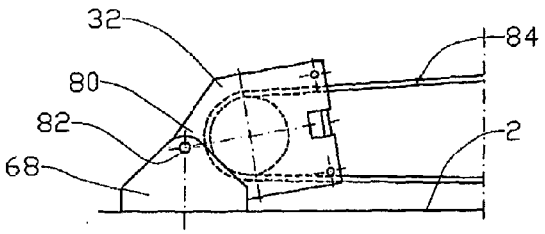
FIG. 9 shows a side view of the roller hook used as a pulley.

FIG. 9 shows the roller hook 32 in use in another type of operation in which it remains pinned to the elevator module 68 but is lifted above the level of the deck 2 via the elevator module for use as a pulley for spooling purposes.

Figure 10:
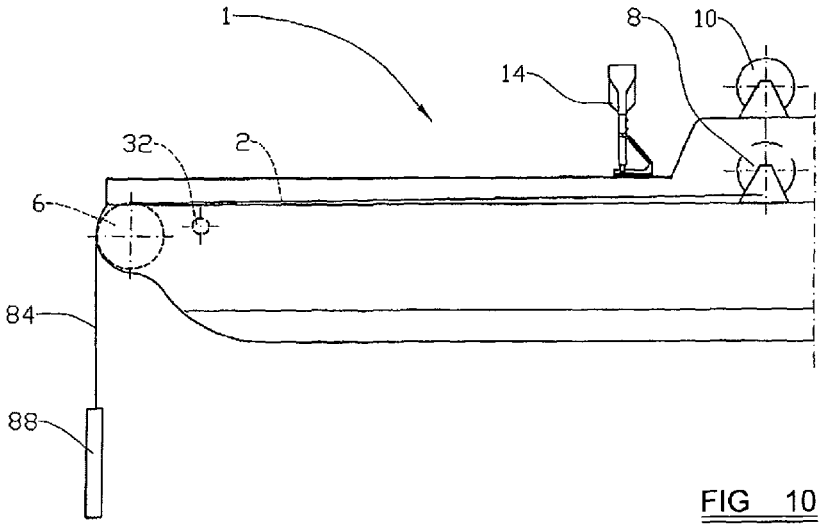
FIG. 10 shows a principal sketch of a vessel where an item is retrieved from the sea and where the rope is passing over the stern roller and to a winch.

When an object 88 such as an anchor is to be retrieved, a rope 84 is run from the heavy winch 8, over one of the stern rollers 6 and is connected to the object 88, as illustrated in FIG. 10. FIG. 10 also shows the crane 14 is in its retracted parked position immediately aft of the vessel's superstructure, while the roller hook 32 is in its idle stowed position below the deck 2.

Figure 11:
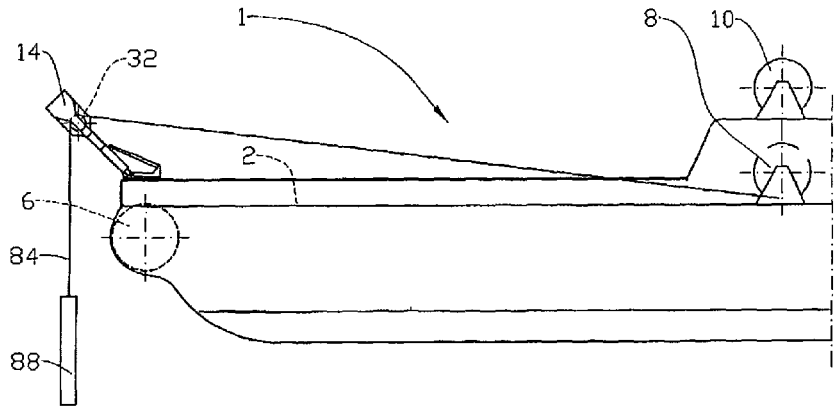
FIG. 11 is a view corresponding generally to that of FIG. 10, but illustrates the rope passing over the roller hook when the roller hook is in its active position on the crane.

The roller hook 32 is then engaged with the rope 84 and connected to the crane 14 as described above. The crane 14 may then he moved to the stern of the vessel 1 and tilted out over the stern via extension of the second hydraulic rams 46 to move the uprights pivotally about their pivot axes 42, as shown in FIG. 11. The object 88 may then be lifted at least partly out of the sea without being bent over the stern roller 6.

Figure 12:
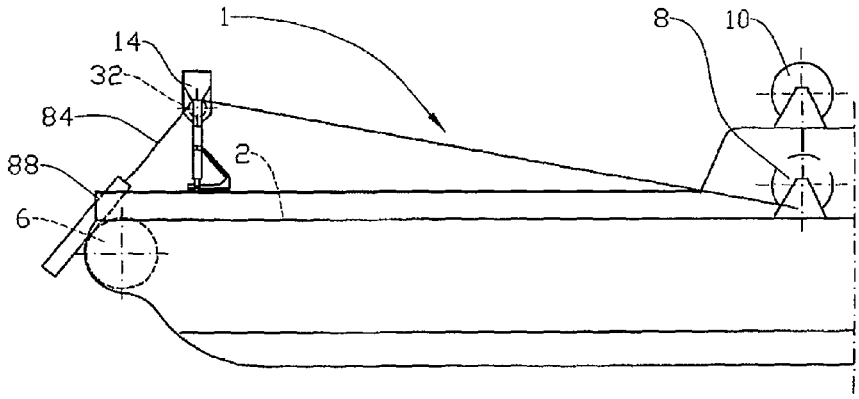
FIG. 12 is a view corresponding generally to that of FIG. 11, but illustrates the item entering the deck of the vessel.

In FIG. 12, the object 88 is shown entering the deck 2 over the stern roller 6 at an angle that that creates significantly less tension in the rope 84 than would be the case if the object were pulled onto the deck with the rope 84 passing directly over the stem roller 6 as in the prior art.

Figure 13:
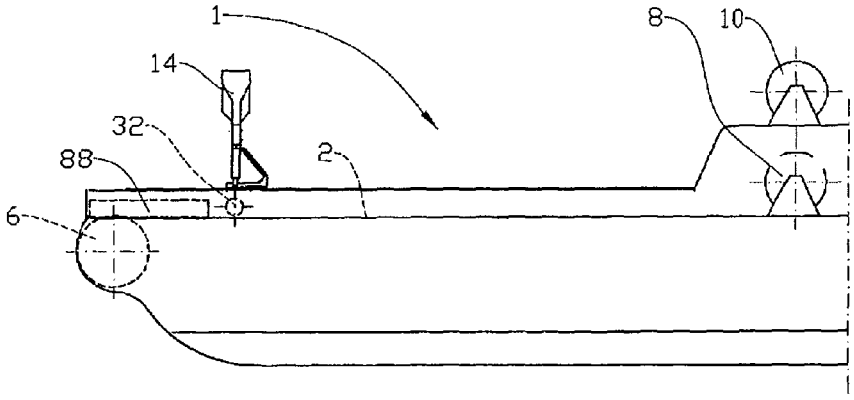
FIG. 13 is a view corresponding generally to that of FIG. 12, but which shows the arrangement after the item has been retrieved onto the deck and the roller hook has been lowered to its stowage position.

FIG. 13 shows the object 88 retrieved and located on the deck 2, with the roller hook 32 having been lowered back down to the deck 2 to a position favourable for disconnecting the rope from the object.

Turning now to consider FIGS. 14 to 34, a second crane arrangement in accordance with the invention will be described. The same reference numbers are used below to refer to components or parts which are either identical to, or equivalent to corresponding parts or components described above in connection with the arrangement of FIGS. 1 to 12.

Figure 14:
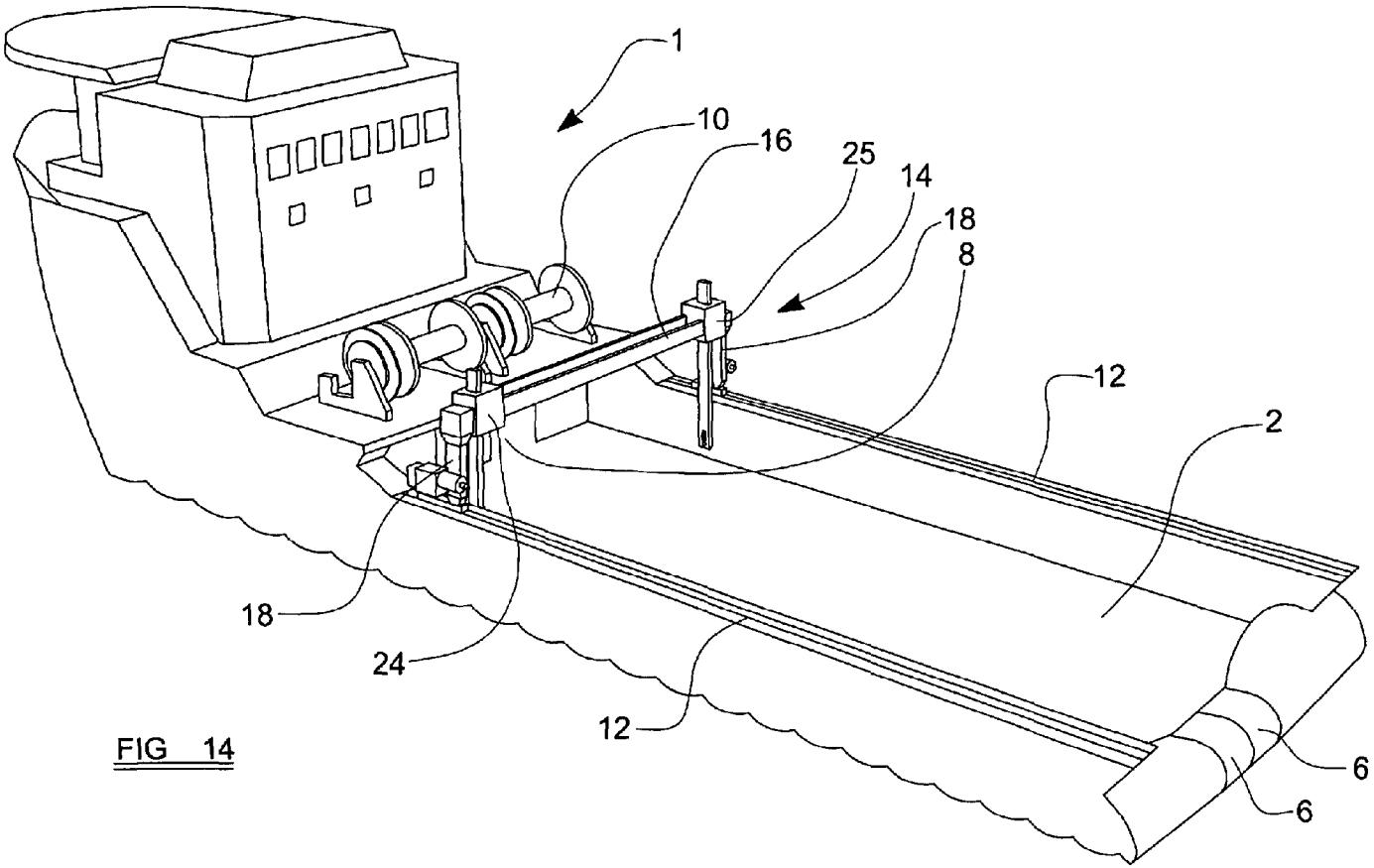
FIG. 14 is a perspective view of vessel for anchor handling operations having a crane arrangement in accordance with another embodiment.

FIG. 14 shows a marine vessel 1 of the same general configuration to that described above and illustrated in FIG. 1; namely an AHTV. The vessel 1 again has a deck 2 including retractable towing pins 4 (not shown in FIG. 1) and stern rollers 6 in a generally conventional configuration. The vessel is also equipped with a heavy winch 8 at deck level and a pair of lighter winches 10 at a position raised above the deck 2, on the vessel's superstructure.

Along each side of the deck 2 there are provided respective tracks 12 for the crane 1 which is again of a travelling gantry type. The tracks 12 are parallel, extend in the stem-to-stem direction of the vessel and are shown mounted to the gunwales of the vessel, at positions raised above the deck 2. However, it is to be appreciated that the tracks could alternatively be mounted in or on the deck 2.

The crane 14 again includes a transverse beam 16 extending between a pair of uprights 18, the uprights being movable on wheels 20 along the tracks 12 in a generally similar manner to that described above with reference to the arrangement of FIGS. 1 to 12.

Whilst the uprights 8 of the particular arrangement shown in FIGS. 14 to 34 are not extendible in the sense of the arrangement of FIGS. 1 to 12, it is envisaged that variants of the illustrated arrangement could have such a configuration.

Two trolleys 24, 25 are mounted to the transverse beam 16 for independent movement along the beam. In the parked position illustrated in FIGS. 14 to 16 it will be noted that one trolley 24 is located at the port end of the beam 16, generally adjacent the upper end of the port upright 18, whilst the other trolley 25 is located at the starboard end of the beam 16, generally adjacent the upper end of the starboard upright 18.

Figure 15:
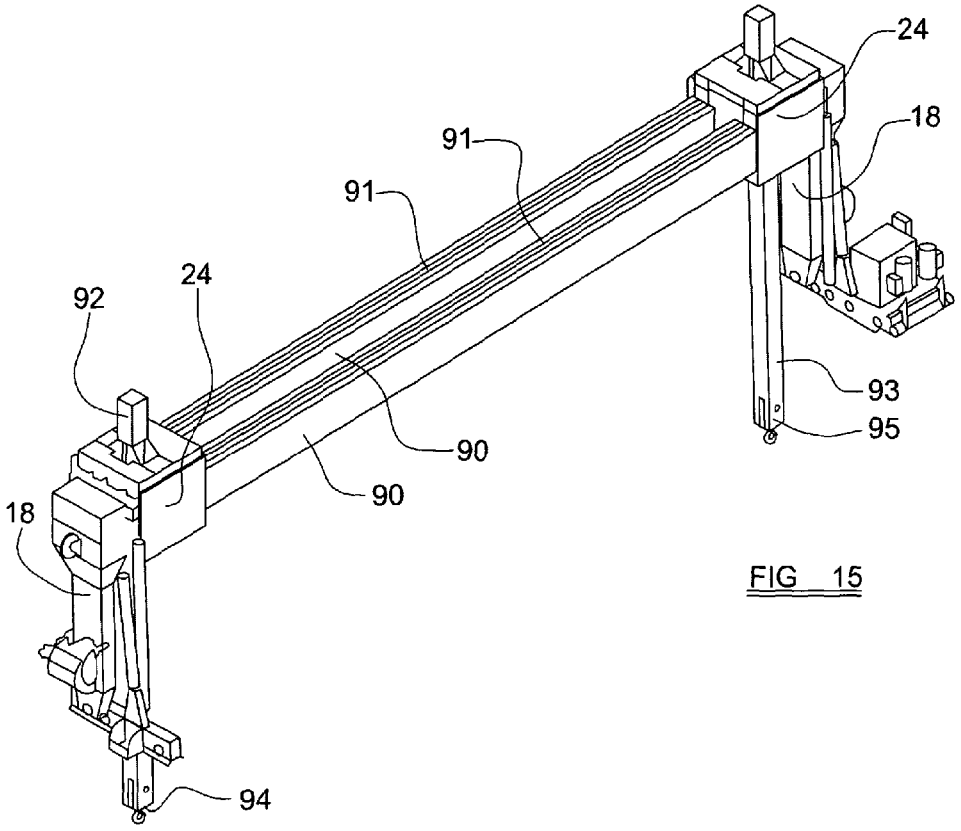
FIG. 15 is a perspective view of the crane arrangement shown separate from the vessel.
Figure 16:
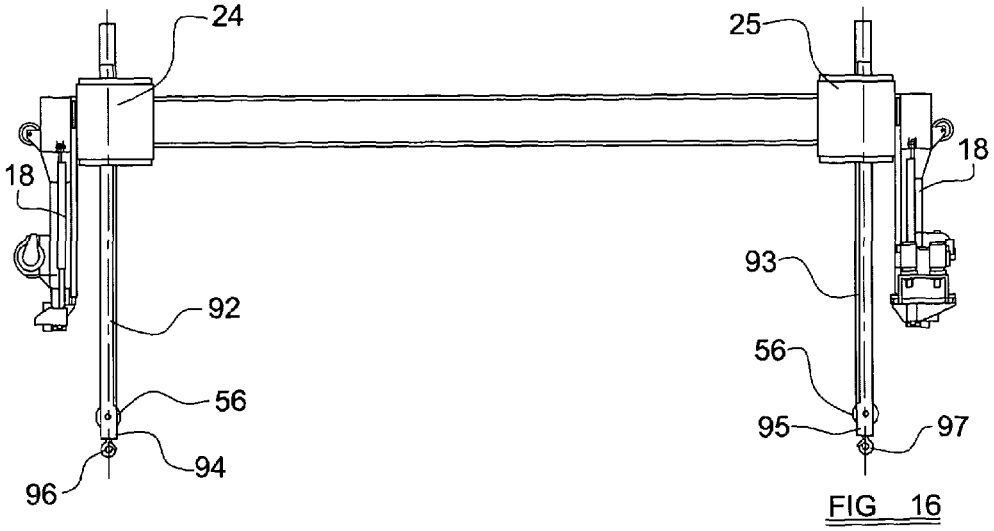
FIG. 16 is an elevational view of the crane arrangement of FIGS. 14 and 15, showing the crane in the position of FIG. 15.

As illustrated most clearly in FIG. 15, the transverse beam 16 comprises a pair of spaced apart parallel members 90, each of which has a track or rail 91 mounted on its upper surface along which the trolleys 24, 25 are mounted for movement along the beam 16.

Each trolley 24, 25 carries a respective lifting arm 92, 93 which forms part of a lifting mechanism operable to lift a load above the deck 2. The lifting arms 92, 93 are each slideably mounted to a respective trolley 24, 25 for sliding movement in a direction substantially parallel to the uprights 18, and the lifting mechanism is operable to move the lifting arms 92, 93 relative to their respective trolleys independently of one another. As indicated most clearly in FIG. 16, the lower end region of each arm 92, 93 carries a rotatably mounted pulley wheel 56. Control wires (not shown) extend down the length of each arm in a loop around the pulley wheels 56 and then return upwardly to the trolleys. The control wires and are used to control the vertical position of the lifting arms 92, 93 in a manner known per se and similar to that in which the length of the lifting arm 22 of the previously described embodiment is controlled.

As will be noted from FIG. 15 in particular, the two lifting arms 92, 93 pass between the two beam members 90 and so any load supported or lifted by the lifting arms will be spread substantially equally between the two beam members 90.

FIGS. 1 to 16 show the two lifting arms 92, 93 in parked positions in which they extend downwardly from their respective trolleys with their lower ends 94, 95 spaced above the deck 2. As will also be noted, the lifting arms are each shown with a lifting hook 96, 97 fitted to their lower ends.

Figure 17:
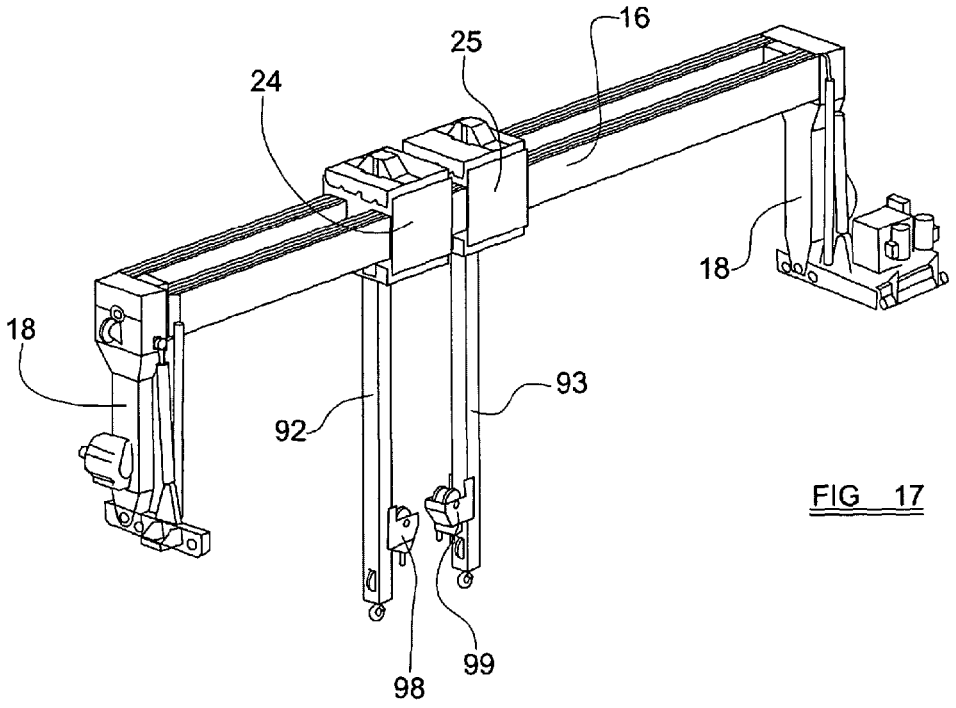
FIG. 17 is a generally similar view to FIG. 15, but shows the crane in an alternate position/configuration.
Figure 18:
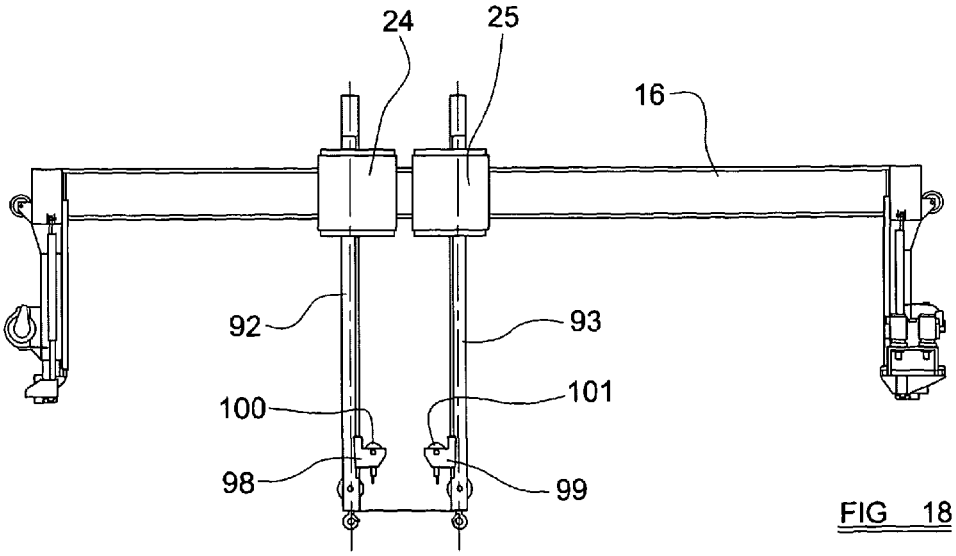
FIG. 18 is a generally similar view to FIG. 16, but which shows the crane in the position/configuration of FIG. 17.

FIGS. 17 and 18 show the crane arrangement in a position in which the two trolleys 24, 25 have been moved towards one another so as to sit generally adjacent in a central region of the beam 16. As will be noted, with the trolleys 24, 25 positioned adjacent one another in this mariner, the two lifting arms are spaced from one another. FIGS. 17 and 18 also show the two lifting arms 92, 93 in their fully lowered positions relative to the trolleys 24, 25.

As also shown in FIGS. 17 and 18, each lifting arm 92, 93 is provided with a respective lifting member 98, 99, the lifting members being mounted to the arms for sliding movement along the length of the arms. The lifting members 98, 99 are each arranged so as to extend in an inboard direction from the arm on which they are mounted towards the other arm, and so in this manner the lifting members 98, 99 are arranged in facing relation to one another, with each occupying a space between the two lifting arms 92, 93. Each lifting member 98, 99 has a rotatably mounted sheave 100, 101 around which a control wire (not shown) is passed, looping down from the trolley above in a manner known per se. The two lifting members 98, 99 are moved along their respective arms 92, 93 under the control of the wires. The lifting mechanism can be controlled either to move the two lifting members 98, 99 independently of one another or in synchronism.

As will therefore be appreciated, the lifting arms 92, 93 and the lifting members 98, 99 all form part of the overall lifting mechanism of the crane arrangement. It is to be noted that the lifting mechanism is operable to move the two arms 92, 93 relative to their respective trolleys 24, 25 entirely independently of any movement between the lifting members 98, 99 and the arms. This means that either arm 92, 93 can be raised or lowered relative to its supporting trolley 24, 25 either with its respective lifting member 98, 99 remaining stationary with respect to the arm, or with simultaneous movement of the lifting member 98, 99 either up or down the arm. Similarly, the lifting members 98, 99 can both be moved with or without simultaneous movement of their respective lifting arms 92, 93. This functionality of the lifting mechanism provides for considerable flexibility in lifting operations.

Figure 19:
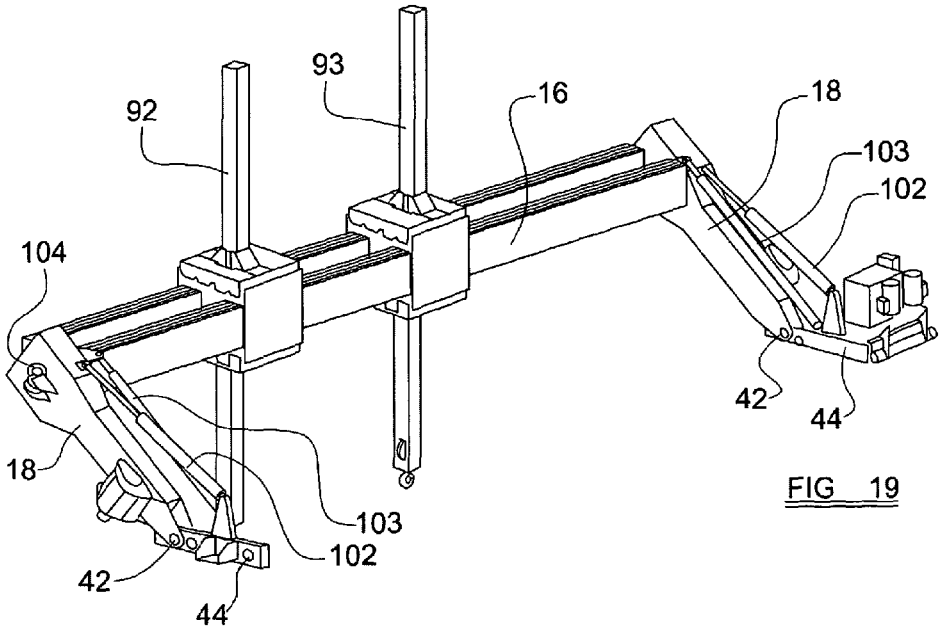
FIG. 19 is perspective view showing the crane in another alternate position/configuration.
Figure 20:
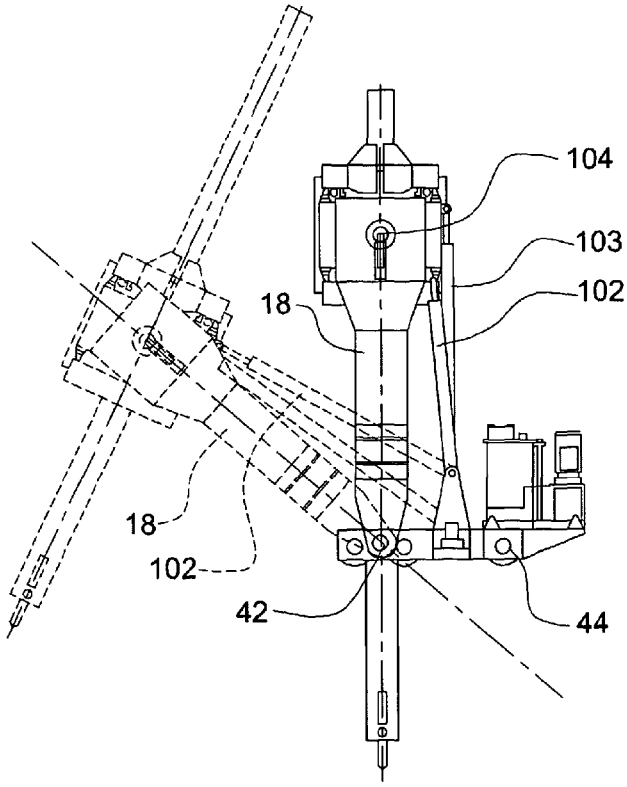
FIG. 20 is an elevational view showing the crane in the position/configuration of FIG. 19.

Turning now to consider FIGS. 19 and 20, the crane arrangement is illustrated in an alternate, tilted position. It will thus be appreciated that the crane arrangement of this embodiment has a similar tilting function to that of the embodiment illustrated in FIGS. 1 to 13. More particularly, each upright 18 is again pivotally mounted about a substantially horizontal pivot axis 42 to a respective carriage 44, the carriages holding the wheels 20 for movement along the tracks 12.

A first actuator 102 in the form of a hydraulic ram is connected between each carriage 44 and an upper end of each upright 18. FIG. 20 illustrates in solid lines the position of the crane arrangement when the two actuators 102 are each in their fully retracted positions, and it will be seen that in this condition the two uprights 44 both extend substantially vertically upwards from the carriages 44. As illustrated in FIG. 19, and in phantom in FIG. 20, extension of the two actuators 102 is effective to tilt the uprights 18 in an aft direction about the axes 42.

Additionally, a pair of second actuators 103 are also provided, each of which also takes the form of a hydraulic ram. The second actuators 103 are each connected between a respective carriage and a corresponding end part of the transverse beam 16. The transverse beam 16 is pivotally connected at each end to a respective upright 18 for rotation about an axis 104 running parallel to the length of the beam 6 and transversely relative to the vessel 1. As will thus be apparent, the beam 16 is mounted for rotational movement relative to the uprights 18, this movement being controlled via the second actuators 103, independently of the tilting movement of the uprights 18. FIG. 19 shows the uprights 18 tilted rearwardly relative to their supporting carriages 44, and also shows the transverse beam 16 having been simultaneously rotated relative to the uprights, under the control of the second actuators 103, such that the lifting arms 92, 93 remain substantially vertical. In contrast. FIG. 20 shows, in phantom, the uprights 18 tilted rearwardly and the beam 16 also having been rotated relative to the uprights so that the lifting arms 92, 93 adopt a non-vertical position.

Turning now to consider FIG. 21, the crane arrangement 14 is shown installed on an AHTV having a tool store 104 located below the level of the deck 2, on the starboard side of the vessel 1. The tool store 104 takes the form of a cavity formed below the deck, and is provided with slideably retractable doors 105. The doors 105 are shown in FIG. 14 in their retracted positions which are effective to open the tool store 104 for access.

The crane 14 is shown positioned so that the two trolleys 24, 25 are generally adjacent one another at the starboard end of the transverse beam 16. The port trolley 24 is shown positioned immediately above the open tool store 104, and its lifting area 92 is shown extending down towards the tool store. The port lifting arm is thus positioned ready to receive a handling tool from within the tool store, for connection to the lower end of the arm, for example in place of the lifting hook 96 previously illustrated. It will thus be appreciated that the tool store 104 may contain one or more tools for releasable connection to the lower end of each lifting arm 92, 93. Connection of a suitable tool to the arm can either be done manually, involving deck personnel manually lifting the tool from within the store and connecting it to the lower end of the arm located above, or possibly automatically by lowering the arm 92 down into the store 104 and into automatic engagement with the tool.

Figure 21:
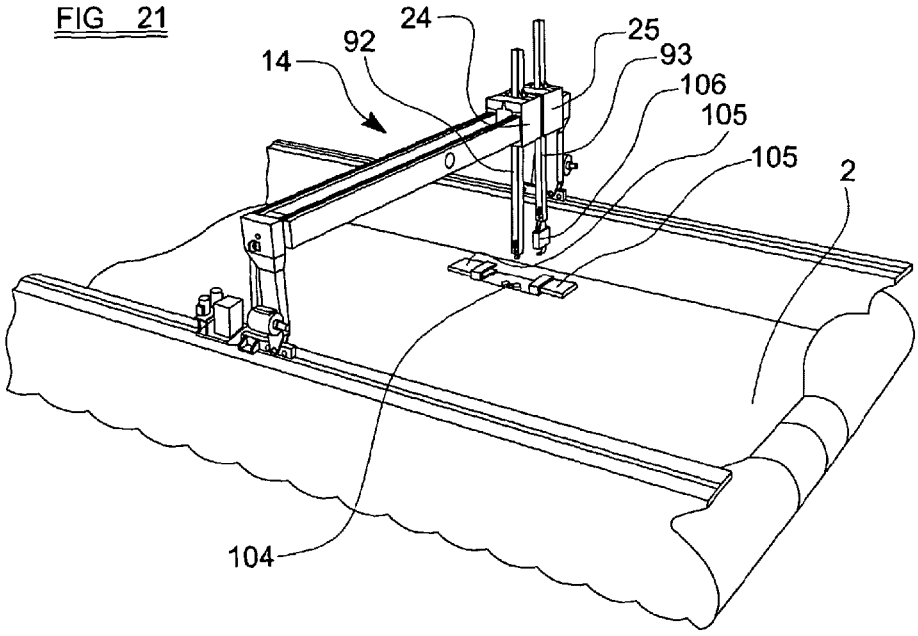
FIG. 21 is a perspective view showing the crane of FIGS. 13 to 20 in a position immediately prior to connection to tools stowed below the deck of the vessel.

FIG. 21 shows the lifting arm 93 of the starboard trolley 25 with a first tool 106 already connected to its lower end, the tool 106 having been retrieved from the tool store 104 as described above.

Figure 22:
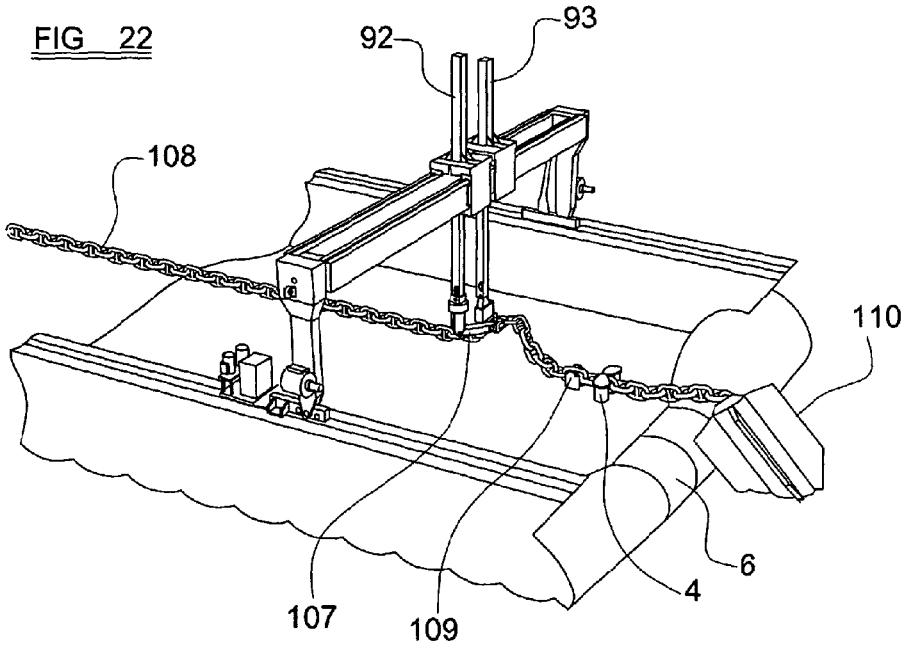
FIG. 22 shows the crane equipped with tools for use in handling an anchor chain.

FIG. 22 shows the crane arrangement with a second tool 107 having been retrieved from the tool store 104 and connected to the lower end of the port lifting arm, both lifting arms thus each having a respective tool connected thereto. The doors 105 of the tool store 104 are closed after selection of appropriate tools. The crane 14 is shown in use handling a heavy chain 108 which runs from the heavy winch 8, through a raised gripping jaw 109, between the raised towing pins 4 and which terminates with a connection to an anchor 110 shown hanging over the rollers 6 at the stern of the vessel. In particular, it will be noted that the second tool 107 connected to the starboard lifting arm is provided in the form of an articulated robotic arm having a gripping jaw 111 at its free end. The robotic arm is configured for remote control, for example by an operative sitting in a control room, remote from the operations on deck.

Figure 23:
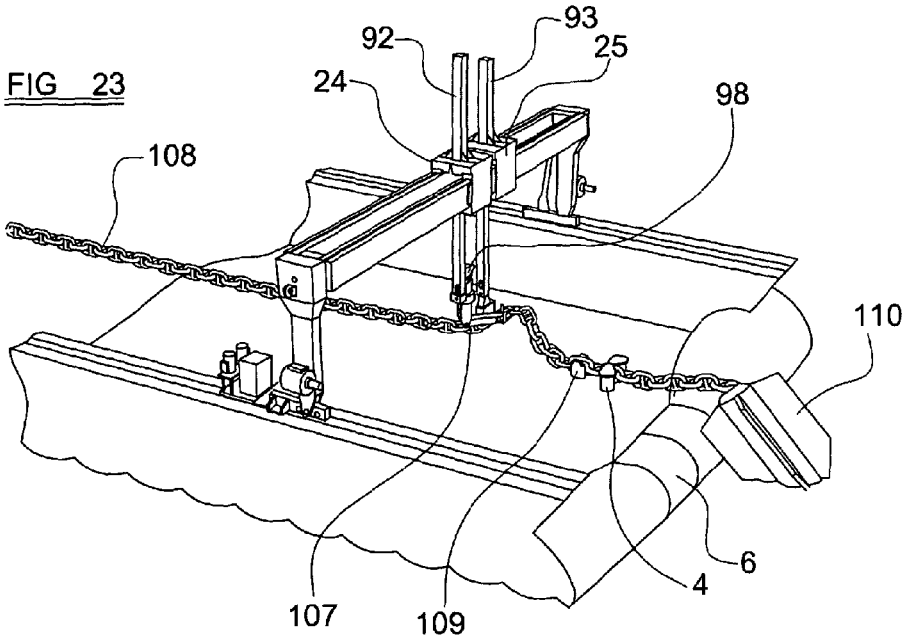
FIG. 23 shows the crane equipped with tools in an alternative manner.

FIG. 23 illustrates the crane 14 performing a similar chain handling operation, but in this arrangement the robotic arm tool 107 is connected to the lifting member 98 of the starboard lifting arm 92 instead of the lower end of the arm itself.

Figure 24:
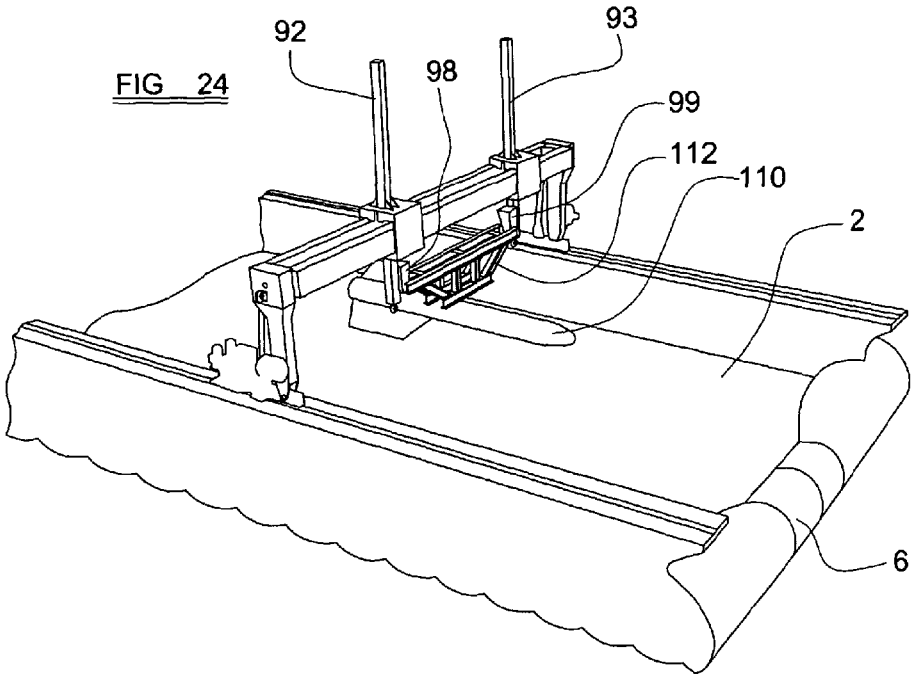
FIG. 24 shows the crane supporting an anchor via a lifting yoke.

FIG. 24 shows the crane 14 in use lifting and transporting a deep sea anchor 110 above the deck 2 in an aftwards direction towards the stem rollers 6 in readiness for launching. The anchor 110 is connected to and suspended from a lifting yoke 112. The lifting yoke 112 is shown connected at opposite ends to respective lifting members 98, 99 and is thus supported between the two lifting arms 92, 93, both of which are in a raised position to lift the anchor 110 clear of the deck 2.

Figure 25:
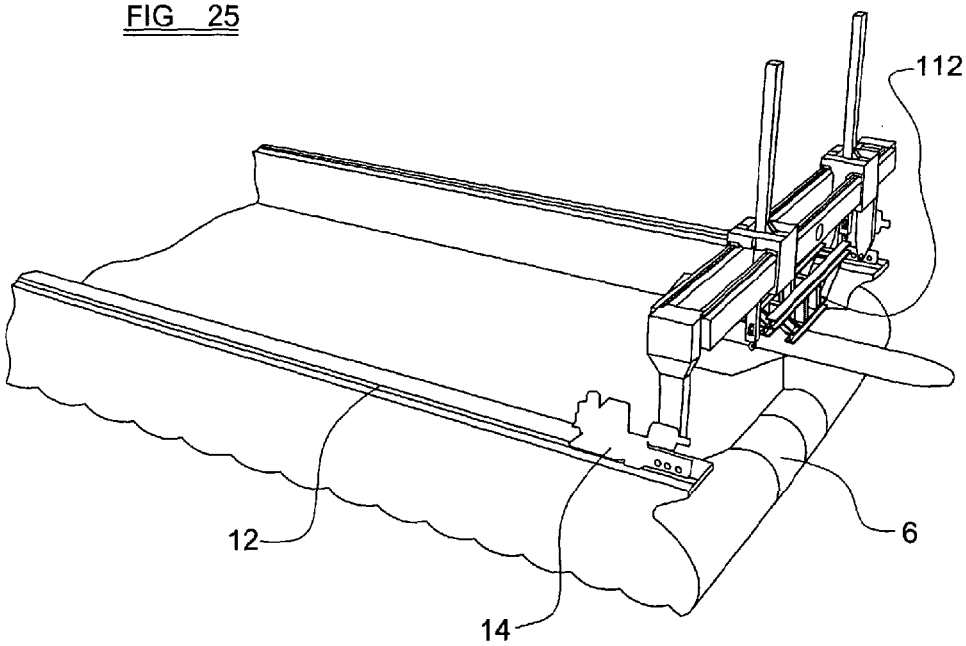
FIG. 25 shows the crane setting the anchor down at the aft end of the vessel's deck.

FIG. 25 shows the crane 4, supporting the yoke 112 and the anchor 110, in its aftmost position in which the carriages 44 are located at the aft ends of their respective tracks 12. In this position, the transverse beam 16 and the lifting arms 92, 93 are located above the aft end of the deck, immediately forward of the stern rollers 6.

Figure 26:
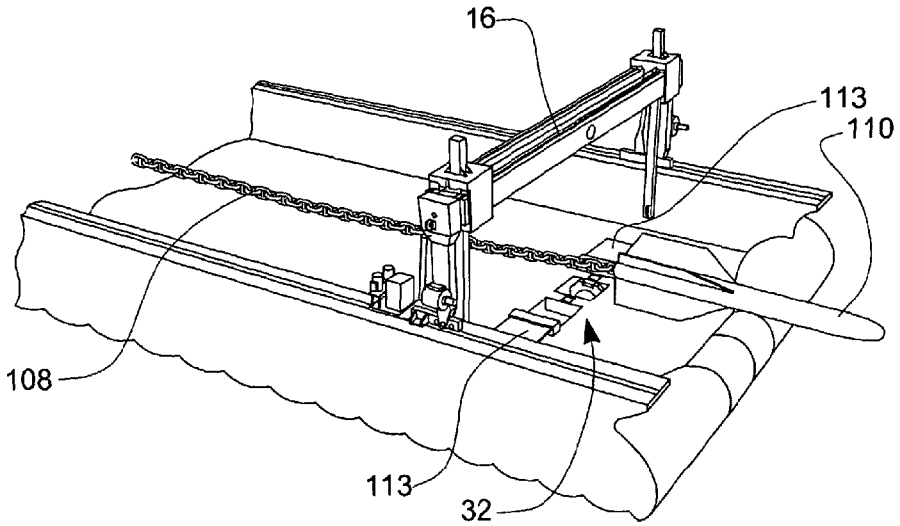
FIG. 26 shows the crane in an alternate position ready for connection to a roller hook, and also shows the roller hook in the deck.

FIG. 26 shows the crane 14 in a subsequent position in preparation for launch of the anchor 10. As will be noted, the anchor 110 has been lowered and set down on the deck adjacent the stern rollers 6. The lifting yoke 112 is not shown in FIG. 26 as it has been moved forwardly by the crane 14 and positioned in a safe stowage position, clear of the launching area.

The heavy anchor chain 108 is shown in FIG. 26 connected to the anchor so as to extend forwardly from the anchor, over the roller hook 32 and along the deck 2 to the heavy winch 8. The roller hook 32 has a generally similar configuration to that previously described and as shown in FIGS. 1 to 13. As will be appreciated, when not in use the roller hook 32 is stowed below the level of the deck behind a pair of sliding doors 113. The doors 113 are shown in FIG. 26 in an open position to provide access to the roller hook 32. The crane 14 is shown in a longitudinal position along the deck 2 which is effective to locate the transverse beam 16 above the roller hook 32.

Figure 27:
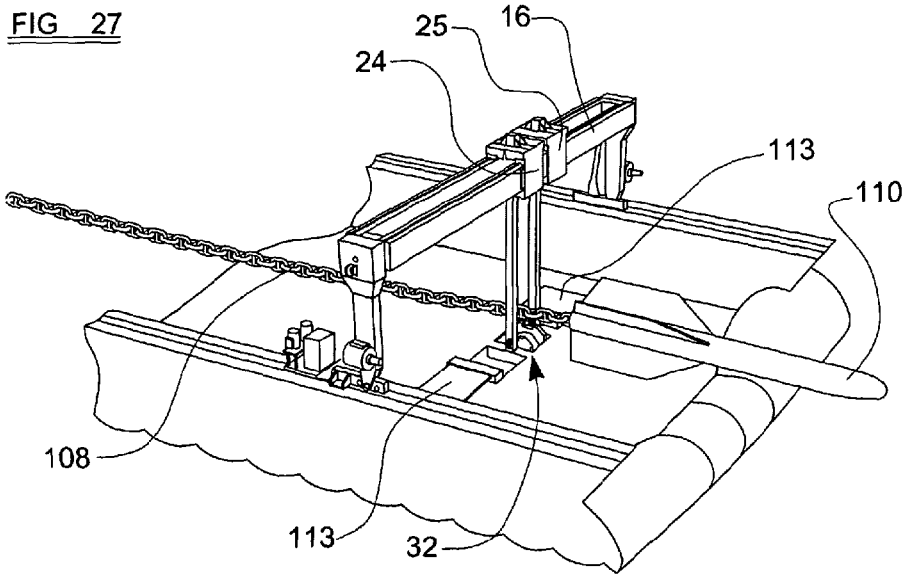
FIG. 27 shows the crane in an initial stage during connection to the roller hook, with support arms extending downwardly to the deck.

The roller hook 32 is positioned below the anchor chain 108, whereupon the trolleys 24, 25 of the crane are moved together so as to be positioned adjacent one another and above the roller hook 32 as shown in FIG. 27. FIG. 27 also shows the two lifting arms 92, 93 in a fully lowered position in which they extend from the level of the deck 2 all the way up to their respective trolleys 24, 25. More particularly, the lower end of each lifting arm 92, 93 is shown engaged in a respective fitting in the form of a socket 114 formed in the cradle 62 on opposite sides of the roller hook 32, as illustrated most clearly in FIG. 28. The lower ends of the lifting arms 92, 93 are releasably locked in position in the sockets 14, for example by suitable catches or the like. The lifting arms 92, 93 are then both locked in position relative to their respective trolleys 24, 25 to resist relative movement between the arms and the trolleys.

Figure 28:
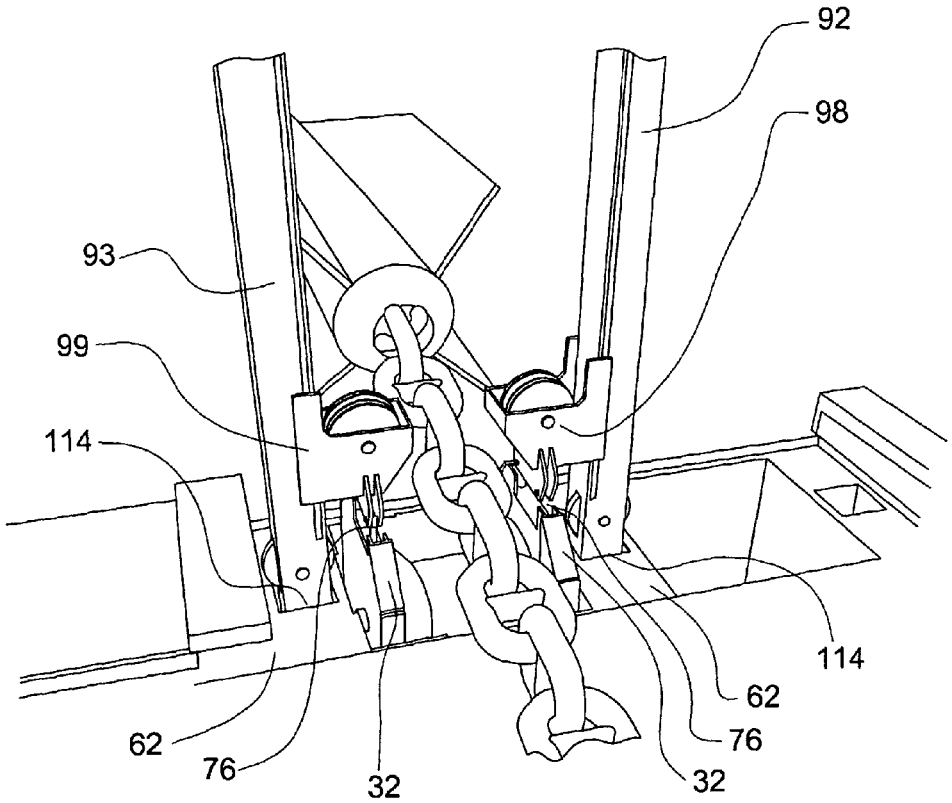
FIG. 28 is a perspective view, from the opposite side, of the lower ends of the support arms, with lifting members associated therewith connected to the roller hook.

FIG. 27 also shows the roller hook 32 having been raised above the level of the deck 2 by the underlying elevating module 68, the catches 76 on the two side members 74 thus being presented in a position above the level of the deck and adjacent respective arms 92, 93. The two lifting members 98, 99 can then be moved downwardly along their respective arms 92, 93 and into engagement with the two catches 76 for releasable connection thereto. This is illustrated in FIG. 28, and in this configuration the roller hook 32 is connected to the two lifting members 98, 99.

Figure 29:
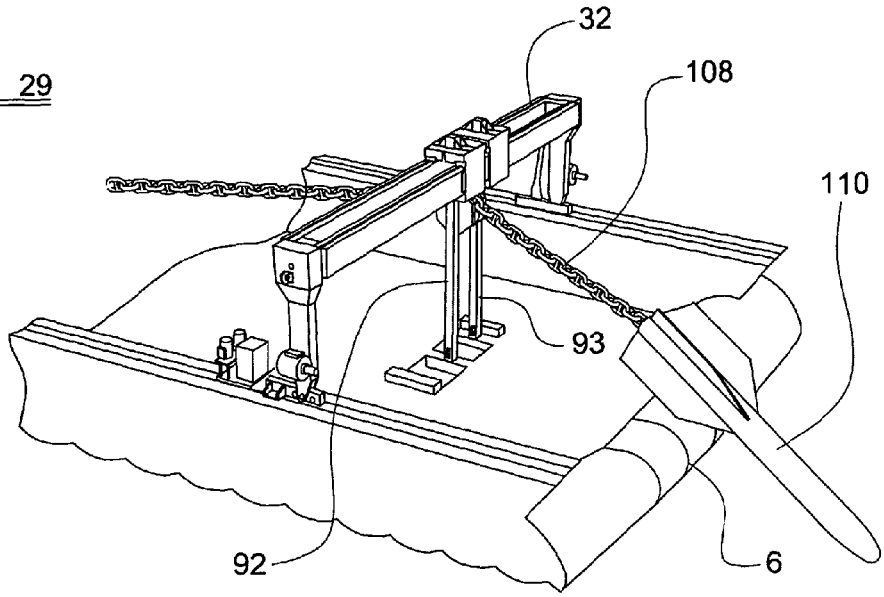
FIG. 29 shows the crane in use to lift the roller hook above the deck.

The crane 14 can then be operated to lift the roller hook 32 upwardly, out of the cradle 62 and towards the transverse beam 16 by moving the two lifting members 98, 99 upwardly along their respective arms as illustrated in FIG. 29. In this manner the crane thus serves a similar function to that described above in connection with the arrangement of FIGS. 1 to 13. However, it is important to note the function of the two lifting arms 92, 93 during this operation.

Because the two lifting arms 92, 93 are locked relative to their respective trolleys 24, 25 at their upper ends, and are received in and connected to the sockets 114 at deck level at their lower ends, they effectively adopt a brace position in which they function as supports to at least partially support the transverse beam 16 (the arms acting in compression) as the crane lifts the roller hook 32 and the associated weight of the chain and anchor. The arms 92, 93 thus relieve the bending stresses which would otherwise be applied to the transverse beam under the weight of the roller hook 32 and associated load of the chain and the anchor.

The lifting arms 92, 93 of the above-described arrangement thus have a dual function.

Firstly, they can be raised or lowered relative to their respective trolleys 24, 25 in order to serve a lifting function as best illustrated in FIGS. 24 and 25. Secondly, they can be used as supporting braces to relieve stress in the beam 16 as heavy loads are lifted by the lifting members 98, 99, as best illustrated in FIG. 29.

It is envisaged that the lifting arms 92, 93 could be used in their bracing function for various other lifting operations apart from the roller hook lifting operation described above. In order to maximise the flexibility of the crane arrangement it is therefore proposed to provide the lower end of each arm 92, 93 with a pad or other such fitting in order to permit the arms to be lowered into brace positions at any of a number of different positions on the deck 2, the pad simply sitting on the upper surface of the deck. In such an arrangement it is envisaged that the only requirement for a suitable bracing position for the arms would be that the deck beneath is sufficiently well supported to withstand the loads likely to be applied by the arms 92, 93 as the crane is used to lift or support a load. Alternatively, the deck 2 may be provided with fittings for connection to the lower ends of the arms at discrete positions around the deck.

Figure 30:
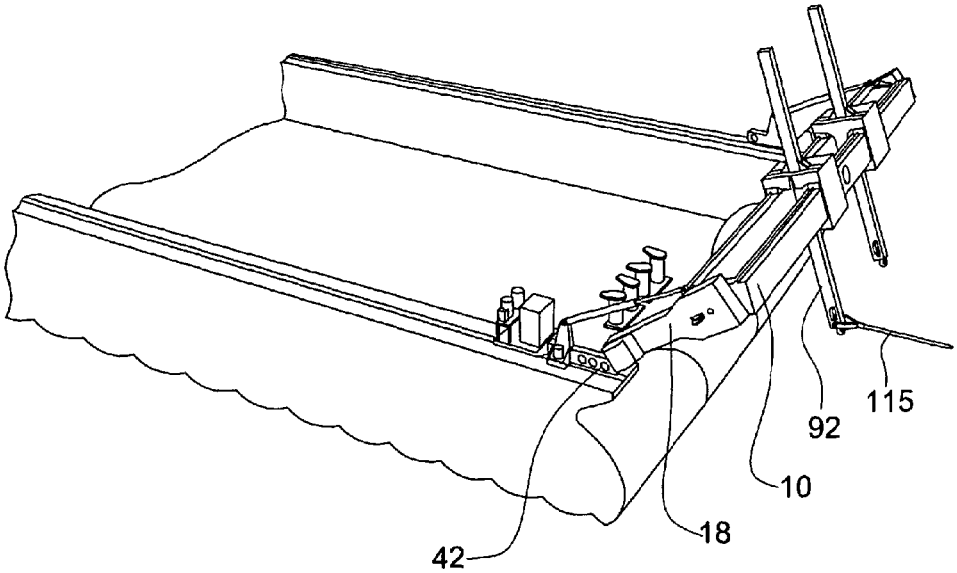
FIG. 30 shows the crane in use in an alternative mode of operation in which it is tilted over the aft end of the vessel.

Turning now to consider FIG. 30, the crane arrangement 14 is shown in use to operate a tool in the form of a boathook 115 which is pivotally connected to the lower end of the one of the lifting arms 92. The crane is positioned as far aft as possible, with its two carriages 44 thus located at the aft ends of the tracks 12. In order to increase the reach of the boathook 115 over the stern of the vessel, the uprights 18 have been tilted rearwardly about their pivot axes 42 in the manner described above in connection with FIGS. 19 and 20. The position of the boathook 115 can also be controlled via pivotal movement of the transverse beam 16 relative to the uprights 18.

Figure 31:
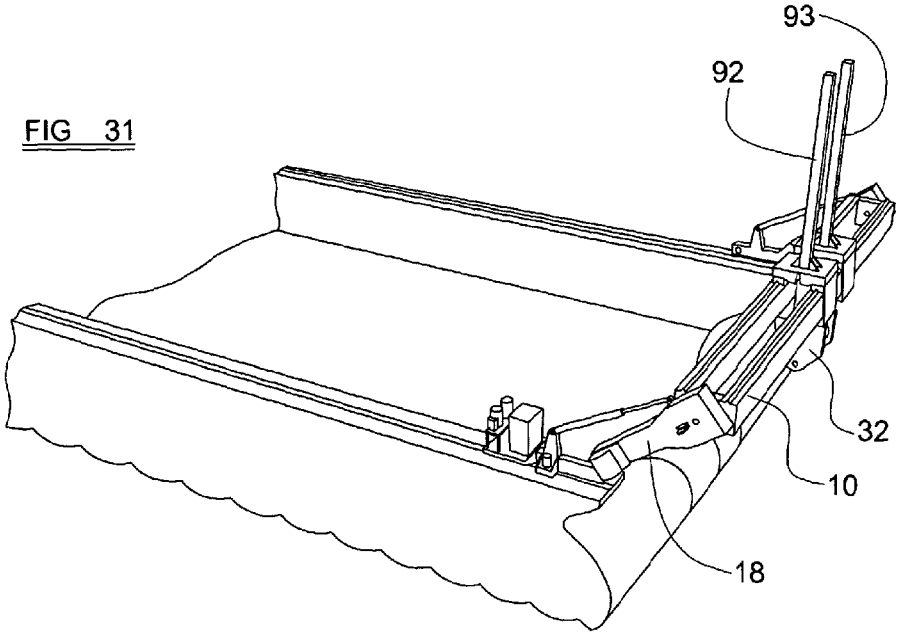
FIG. 31 shows the crane supporting the roller hook over the aft end of the vessel.

FIG. 31 shows the crane 14 in a similar position in which the uprights 18 are tilted rearwardly so as to support the transverse beam 6 over the sea. In this configuration the lifting members 98, 99 are connected to the roller hook 32 and the lifting arms 92, 93 are fully raised so that the roller hook 32 is suspended from the trolleys 24, 25 and is clear from obstruction by the lifting arms. In this configuration the crane 14 and the roller hook 32 can be used for operations involving the lowering of load to the seabed; for example installation of a Christmas tree on a subsea oil-well.

Figure 33:
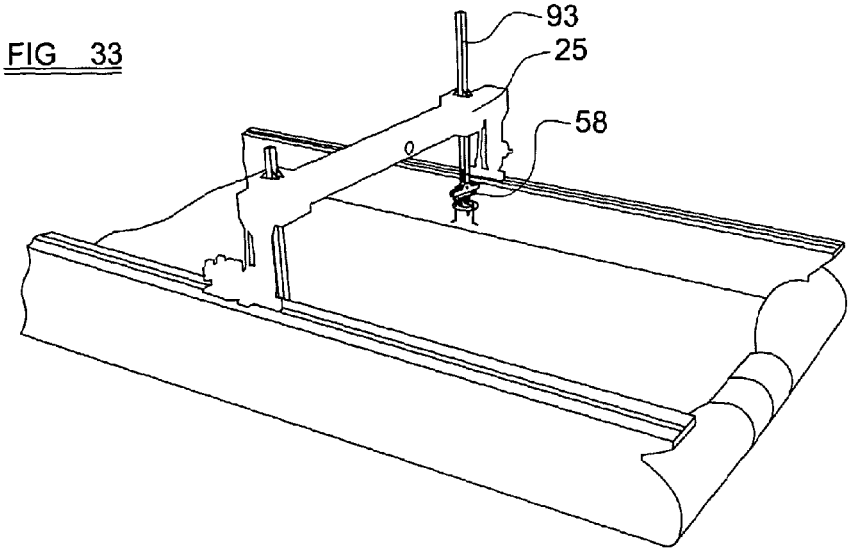
FIG. 33 shows the crane supporting a wire-coiling tool.
Figure 34:
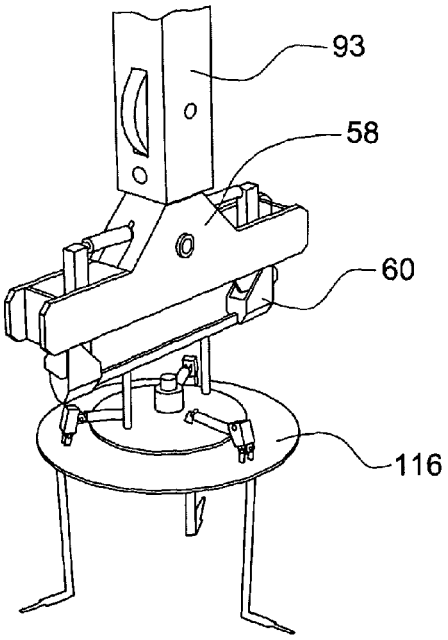
FIG. 34 is an enlarged view showing the wire-coiling tool of FIG. 33 fixed to the lower end of one of the crane's support arms.

As will be appreciated, the above-described configuration of crane, having independently operable trolleys 24, 25, lifting/support arms 92, 93 and lifting members 98, 99 is extremely flexible in terms of its potential uses and the types of deck operations it can be adapted to perform. For example, FIGS. 33 and 34 illustrate the crane 14 being used for wire-winding operations, in which only one trolley 25 and its associated lifting arm 93 are used, the other trolley 24 being left in its parked position. The lower end of the operative arm 93 is shown connected to a cross-beam 58 of generally identical configuration to that described above in connection with FIG. 6. In this arrangement, however, the cross-beam is shown releasably connected, via its hooks 60, to a wire winding tool 116 which is provides for motorised spooling and unwinding of wire coils.

Figure 32:
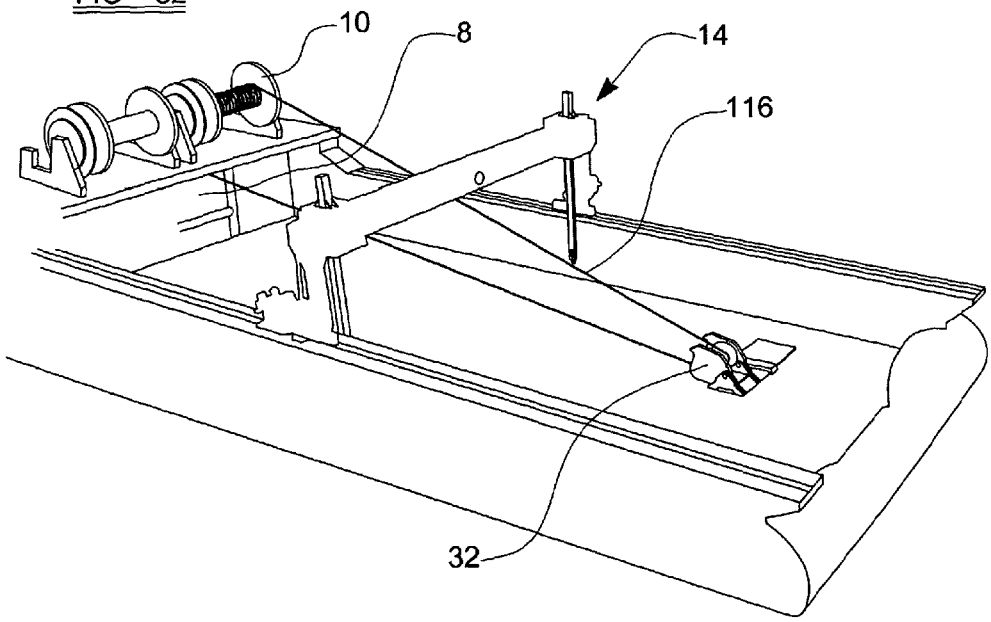
FIG. 32 shows the crane in a parked position and the roller hook in use for spooling a wire between two winches.

FIG. 32 illustrates the crane 14 in an inoperative parked position, and shows the roller hook 32 raised above the level of deck 2 in a similar manner to that illustrated in FIG. 9 discussed above. In this position, the roller hook 32 can be used for spooling operations, for example to spool a wire or a rope 1 16 between the heavy winch 8 and one of the light winches 10 as shown.

Lifting and handling operations onboard a vessel are illustrated under reference to anchor handling work as such operations well illustrate the tasks involved. This is in no way intended to limit the scope of the invention to such applications.

It is to be appreciated that terms of orientation used herein such as "horizontal", "vertical" and derivatives thereof, are intended to refer to the normal orientation of certain components relative to the normal position of the vessel 1 when floating in normal trim in substantially flat water.

When used in this specification and claims, the terms "comprises" and "comprising" and variations thereof mean that the specified features, steps or integers are included. The terms are not to be interpreted to exclude the presence of other features, steps or integers.

It will be understood by those of ordinary skill in the art that the disclosed crane systems can be implemented using any suitable materials and conventional hardware components using the techniques disclosed herein. While certain embodiments have been shown and described, modifications thereof can be made by one skilled in the art without departing from the scope or teachings herein. Many variations and modifications of the crane systems are possible and are within the scope of the invention.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A travelling crane arrangement provided on a floating vessel having a deck and a pair of substantially parallel tracks, the crane arrangement comprising:

a pair of uprights to move along the respective tracks;

a transverse beam extending between said uprights across the deck of the vessel in spaced relation thereto;

a trolley configured to move along the beam, the trolley carrying at least part of a lifting mechanism configured to lift a load above the deck;

wherein the lifting mechanism includes a support selectively positionable in a brace position extending between the deck and the trolley, wherein in the brace position the support is configured to at least partially support the beam in compression during use of the lifting mechanism to lift or otherwise support the weight of a load.

2. The crane arrangement of claim 1, wherein said support comprises an arm slideably mounted to said trolley and configured to move between a retracted position in which a lower end of the arm is substantially clear of the deck and a brace position in which the lower end of the arm engages the deck to support the beam.

3. The crane arrangement of claim 2, wherein said arm forms part of said lifting mechanism and is configured to lift a load when not engaged with the deck, wherein the lifting mechanism is configured to lift said load by slideably raising the arm relative to the trolley.

4. The crane arrangement of claim 2, wherein said lifting mechanism comprises a lifting member configured to move along said support, wherein the lifting mechanism is configured to lift a load via upwards movement of the lifting member along the support.

5. The crane arrangement of claim 4, wherein said lifting mechanism is configured to independent move said arm relative to said trolley and said lifting member relative to said arm.

6. The crane arrangement of claim 5, wherein said lifting mechanism is configured to move said lifting member relative to said arm with said arm in the brace position.

7. The crane arrangement of claim 4, wherein said lifting member comprises a rotatably mounted sheave, the lifting member being configured to move along said support via movement of a wire or rope passing around the sheave.

8. The crane arrangement of claim 4, further comprising a tool releasably coupled to said lifting member.

9. The crane arrangement of claim 3, further comprising a tool releasably coupled to the lower end of said arm.

10. The crane arrangement of claim 8, wherein the tool is a gripping tool.

11. The crane arrangement of claim 8, wherein the tool is remotely controlled.

12. The crane arrangement of claim 11, wherein the tool comprises a robotic arm.

13. The crane arrangement of claim 1, further comprising a pair of trolleys, each trolley configured to move independently along said beam and having a respective support.

14. The crane arrangement of claim 13, wherein each support has a respective said lifting member, the lifting mechanism being operable to raise and lower said lifting members either independently of one another or in synchronism.

15. The crane arrangement of claim 14, wherein said lifting members are arranged in facing relation to one another and are configured to be connected to a respective part of a load extending between said supports.

16. The crane arrangement of claim 1, further comprising a pair of carriages , wherein each carriage is configured to move along one of the tracks, wherein each upright is pivotally coupled to one of the carriages and is configured to tilt about a substantially horizontal axis.

17. The crane arrangement of claim 16, wherein said beam is pivotally connected to each upright about a substantially horizontal axis and is configured to tilt relative to said uprights.

18. The crane arrangement of claim 2, wherein the lower end of the arm is releasably coupled to a fitting mounted in or on the deck when the arm is in the brace position.

19. A floating marine vessel for lifting a load, the vessel comprising:

a deck;

a pair of parallel tracks dispose on the deck;

a crane moveably coupled to the deck, wherein the crane comprises:

a first upright moveably coupled to a first of the pair of tracks;

a second upright moveably coupled to a second of the pair of tracks;

a beam extending between the first upright and the second upright;

a first trolley coupled to the beam, wherein the first trolley is configured to move along the beam;

wherein the first trolley carries a first arm moveably coupled to the first trolley;

a first lifting member moveably mounted to the first arm;

wherein the first lifting member is configured to at least partially lift the load;

wherein the first arm is selectively positionable in a brace position extending between the deck and the first trolley, wherein in the brace position the first arm is configured to at least partially support the beam in compression during use of the first lifting mechanism to lift or otherwise support the weight of a load.

20. The floating marine vessel of claim 19, further comprising:

a second trolley coupled to the beam;

wherein the second trolley carries a second arm moveably coupled to the second trolley, wherein the first trolley is configured to move along the beam between the first upright and the second trolley, and wherein the second trolley is configured to move along the beam between the second upright and the first trolley;

a second lifting member moveably mounted to the second arm;

wherein the first lifting member and the second lifting member are configured to lift the load together.

21. The floating marine vessel of claim 20, wherein the beam comprises a pair of spaced apart parallel members, wherein each trolley is moveably coupled to the pair of parallel members.

22. The floating marine vessel of claim 21, wherein each arm extends between the pair of parallel members.

23. The floating marine vessel of claim 19, wherein the first arm is configured to move between a retracted position spaced apart from the deck and a support position engaging the deck.

24. The floating marine vessel of claim 19, further comprising:

a roller hook including a roller mounted for rotation about an axis between a pair of spaced apart side members, wherein the roller hook is configured to move between a stowed position beneath the deck and a deployed position extending upward from the deck.

25. The floating marine vessel of claim 24, wherein one of the side members is configured to releasably couple to the first lifting member.

26. The floating marine vessel of claim 24, wherein the roller hook is received within a cradle in the stowed position, and wherein the cradle is configured to move transversely relative to the deck.

* * * * *